US010770817B2

(12) United States Patent
Kimura et al.

(10) Patent No.: US 10,770,817 B2
(45) Date of Patent: Sep. 8, 2020

(54) TERMINAL MODULE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akio Kimura, Mie (JP); Kyohei Ida, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/478,296

(22) PCT Filed: Jan. 15, 2018

(86) PCT No.: PCT/JP2018/000826
§ 371 (c)(1),
(2) Date: Jul. 16, 2019

(87) PCT Pub. No.: WO2018/135436
PCT Pub. Date: Jul. 26, 2018

(65) Prior Publication Data

US 2019/0372260 A1 Dec. 5, 2019

(30) Foreign Application Priority Data

Jan. 18, 2017 (JP) ..... 2017-006350

(51) Int. Cl.
*H01R 13/33* (2006.01)
*H01R 13/24* (2006.01)

(52) U.S. Cl.
CPC ..... *H01R 13/2421* (2013.01)

(58) Field of Classification Search
CPC ..... H01R 13/2421; H01R 13/33; H01R 13/22
See application file for complete search history.

(56) References Cited

U.S. PATENT DOCUMENTS 3,422,395 A * 1/1969 Fisher ..... H01R 13/115 439/889
7,547,215 B1 * 6/2009 Mark ..... H01R 13/15 439/66

(Continued)

FOREIGN PATENT DOCUMENTS

DE 1 137 783 10/1962
JP 51-6694 2/1976

(Continued)

OTHER PUBLICATIONS

International Search Report dated Feb. 13, 2018.

*Primary Examiner* — Truc T Nguyen
(74) *Attorney, Agent, or Firm* — Gerald E. Hespos; Michael J. Porco; Matthew T. Hespos

(57) ABSTRACT

A terminal module includes an electrical contact having a body (30) configured to face a butting portion (82) on a mating terminal, oriented such that a coil axis (P) is parallel to the body (30) of the electrical contact member and configured to be sandwiched between the mating terminal and the electrical contact (20) to be tilted toward the coil axis (P) when the mating terminal and the electrical contact (20) approach. At least one of a facing surface (31) on the body (30) of the electrical contact (20) on which the obliquely wound coil spring (60) slides and a contact surface (81) on the butting portion (82) of the mating terminal on which the obliquely wound coil spring (60) slides is formed into an uneven surface for increasing frictional resistance during sliding.

6 Claims, 9 Drawing Sheets

(56) References Cited

U.S. PATENT DOCUMENTS

| | | | | |
|---|---|---|---|---|
| 7,794,255 | B2 * | 9/2010 | Melni | H01R 4/56 439/271 |
| 8,844,126 | B2 * | 9/2014 | Frederick | H01R 13/33 29/876 |
| 2004/0002234 | A1 * | 1/2004 | Masao | H01R 12/52 439/66 |
| 2011/0124245 | A1 * | 5/2011 | Fujita | H01R 13/17 439/840 |
| 2011/0263164 | A1 * | 10/2011 | Lenhert | H01R 13/33 439/816 |
| 2011/0294343 | A1 * | 12/2011 | Alaria | H01R 13/5219 439/527 |
| 2014/0094048 | A1 * | 4/2014 | Dilmaghanian | H01R 24/58 439/271 |
| 2016/0041055 | A1 * | 2/2016 | Bousquet | G01L 19/0061 73/754 |
| 2017/0170586 | A1 * | 6/2017 | Loy | H01R 13/2442 |
| 2017/0373425 | A1 * | 12/2017 | Rust | H01R 13/2421 |
| 2019/0140375 | A1 * | 5/2019 | Schafmeister | H01R 13/05 |

FOREIGN PATENT DOCUMENTS

| | | |
|---|---|---|
| JP | 8-52918 | 2/1994 |
| JP | 2008-204634 | 9/2008 |
| JP | 5382439 | 1/2014 |
| JP | 2014-170626 | 9/2014 |

* cited by examiner

TERMINAL MODULE

BACKGROUND

Field of the Invention

This specification relates to a terminal module.

Related Art

Japanese Unexamined Patent Publication No. 2008-204634 discloses a contact device for connecting a pair of terminals using a conductive coil spring between the terminals. The coil spring of Japanese Unexamined Patent Publication No. 2008-204634 is formed into a spring contact having an elliptical winding surface by inclining a wire made of a conductive spring material with respect to a winding axis and spirally winding the wire. Further, both end parts of the wire of the spring contact are joined into an annular shape, and the annular spring contact is fit in grooves in the outer peripheries of the terminals.

However, if the spring contact is used in an annular state, grooves are formed in cylindrical outer surfaces or cylindrical inner outer surfaces. Forming grooves increases cost. Further, since the spring contact is used in the annular state, miniaturization is difficult. Furthermore, if the spring contact is used in a straight state, the entire length of the spring contact becomes shorter when the wire is tilted and deformed. However, if the spring contact is used in the annular state, the entire length is maintained. Therefore, tensile stress acts on the wire and the wire easily is settled. Thus, the spring contact desirably is used in the straight state without being formed into an annular shape. However, if the straight spring contact is brought into contact with a surface of a busbar, it is difficult to ensure a contact pressure if the surface of the busbar is a smooth surface since the wire of the spring contact slides on the surface of the busbar. As a result, even if the wire having the same thickness is used, it is difficult to reduce contact resistance as compared to the case where the spring contact is used in the annular state.

SUMMARY

A terminal module disclosed by this specification includes an electrical contact member having a body configured to face a butting portion on a mating terminal, and an obliquely wound coil spring coiled by winding a conductive wire material a plurality of times. The coil spring is oriented such that a coil axis is parallel to the body of the electrical contact, and is configured to be sandwiched between the mating terminal and the electrical contact member to be tilted toward the coil axis when the mating terminal and the electrical contact member approach. At least one of a facing surface on the body of the electrical contact on which the obliquely wound coil spring slides and a contact surface on the butting portion of the mating terminal on which the obliquely wound coil spring slides is formed into an uneven surface for increasing frictional resistance during sliding.

According to this configuration, at least one of the contact surface and the facing surface is formed into an uneven surface, frictional resistance increases by the obliquely wound coil spring sliding on the uneven surface. Thus, the obliquely wound coil spring is less likely to be tilted toward the coil axis and a contact pressure increases, with the result that contact resistance is reduced. The conductive wire material of the obliquely wound coil spring may be thickened to increase the contact pressure, but this design is not a good idea for the following reasons. If the conductive wire material is thickened, the obliquely wound coil spring becomes larger. This is disadvantageous in miniaturizing the entire terminal module. In addition, the flexibility of the conductive wire material is reduced to make the obliquely wound coil spring easily settled.

In short, by adopting the above configuration, connection reliability equal to or more than that before can be obtained while the conductive wire material thinner than before is used. Further, by thinning the conductive wire material, flexibility increases, the settling of the obliquely wound coil spring is less likely to occur and the entire terminal module can be miniaturized. Further, since the obliquely wound coil spring need not be formed into an annular shape, the terminal module can be processed inexpensively. Furthermore, the obliquely wound coil spring is enabled to be naturally deflected and deformed. Therefore extra stress and the like do not act on the conductive wire material and an effect of making the obliquely wound coil spring less likely to be settled can be expected.

Both the facing surface and the contact surface may be formed into uneven surfaces. According to this configuration, the obliquely wound coil spring is less likely to be tilted with respect to the coil axis. Thus, the contact pressure increases and the contact resistance decreases. As a result larger current applications can be dealt with.

A holder may hold the electrical contact member and the obliquely wound coil spring, and the mating terminal may be insertable into the holder. According to this configuration, the configuration of the electrical contact member can be simplified as compared to the case where the obliquely wound coil spring is held by the electrical contact member. For example, the electrical contact member need not be provided with a hole or the like for fixing the obliquely wound coil spring. Thus, the processing cost of the electrical contact member is reduced and a conductor cross-sectional area of the electrical contact member is not reduced by the hole.

According to the terminal module disclosed by this specification, the obliquely wound coil spring is less likely to be tilted toward the coil axis and the contact pressure can be increased.

DETAILED DESCRIPTION

Figure 1:
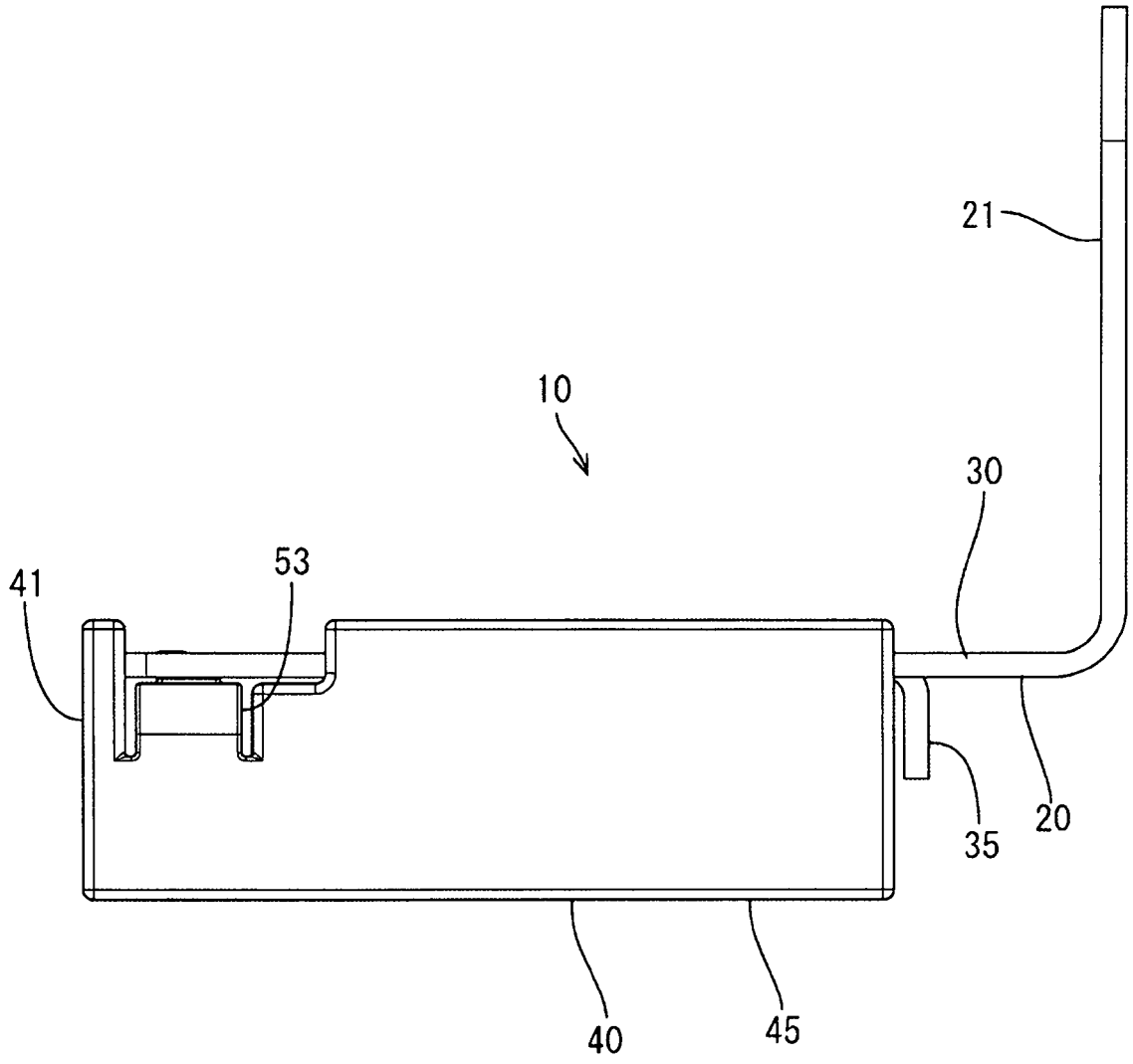
FIG. 1 is a side view of a terminal module.
Figure 2:
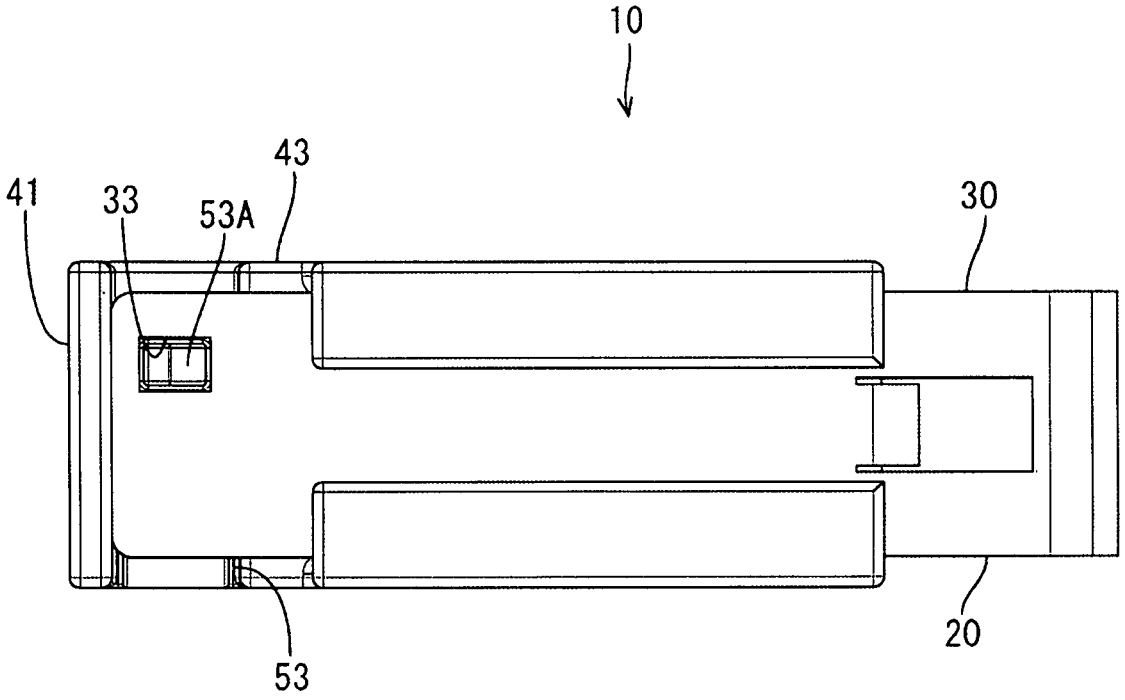
FIG. 2 is a plan view of the terminal module.

An embodiment is described with reference to FIGS. 1 to 8. A terminal module 10 of this embodiment is connected electrically to a mating terminal 80 by being butted against the mating terminal 80. The terminal module 10 includes an electrical contact 20, a holder 40 and an obliquely wound coil spring 60. In the following description, an upper side in FIG. 4 is referred to as an upper side and a lower side in FIG. 4 (side of the mating terminal 80) is referred to as a lower side. Further, a left side in FIG. 1 is referred to as a front side and a right side in FIG. 1 (side of an externally connecting portion 21) is referred to as a rear side.

Figure 3:
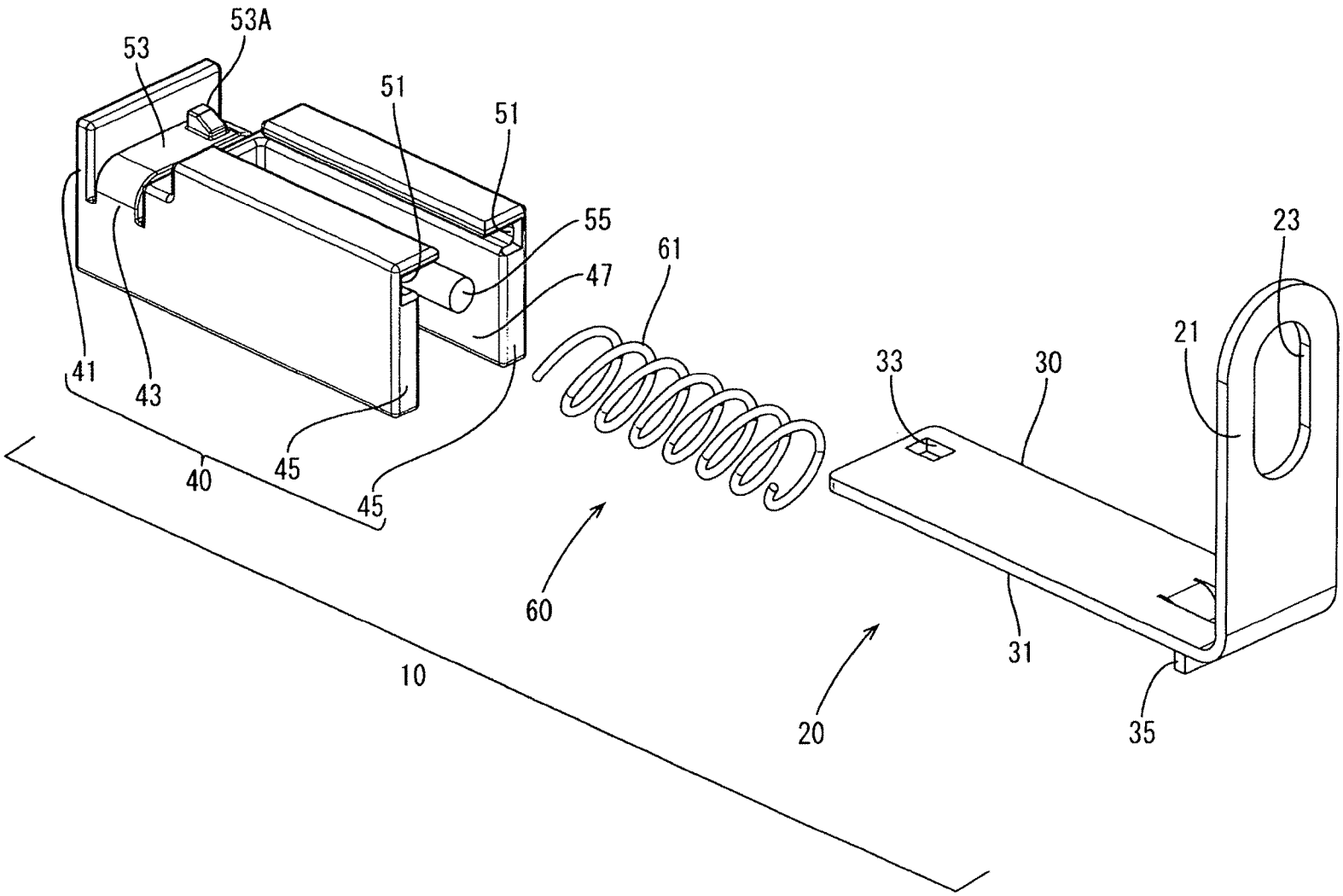
FIG. 3 is an exploded perspective view of the terminal module.
Figure 4:
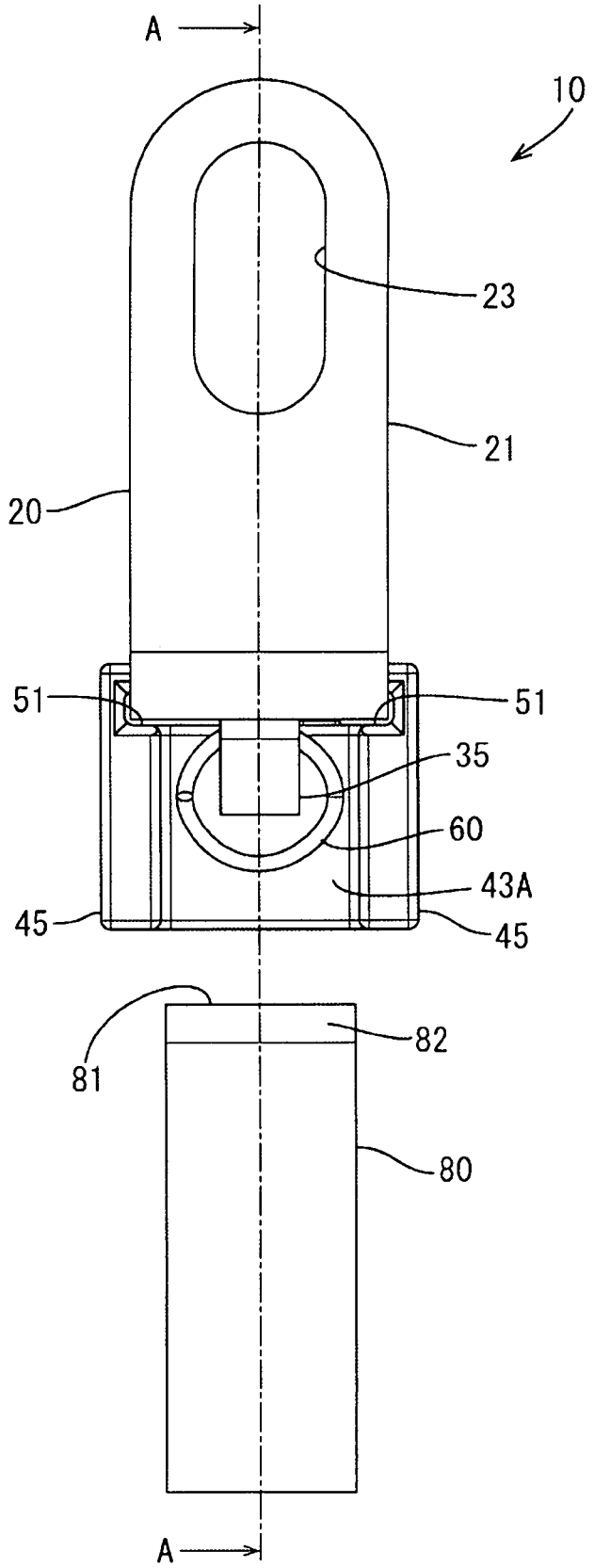
FIG. 4 is a back view showing a state before the terminal module is connected to a mating terminal.
Figure 8:
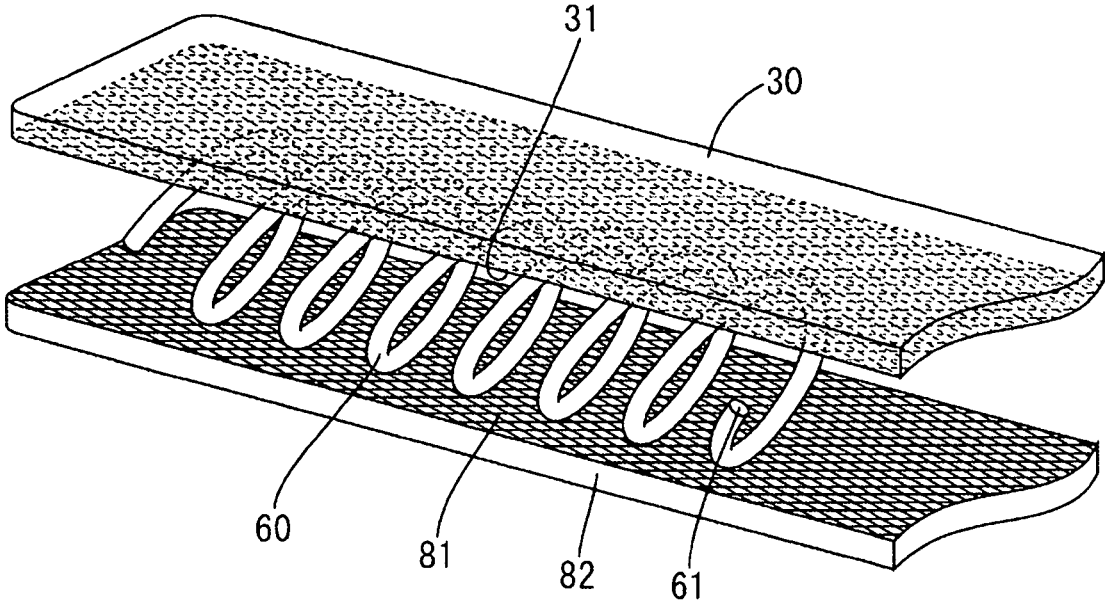
FIG. 8 is a perspective view showing a state where an obliquely wound coil spring is disposed between a contact surface and a facing surface.

As shown in FIGS. 1 and 3, the electrical contact 20 is formed by press-working a metal plate material, such as copper alloy, and is substantially L-shaped. The electrical contact 20 has a facing surface 31 to be brought into contact with the obliquely wound coil spring 60, and includes a body 30 configured to face a butting portion 82 of the mating terminal 80 and the externally connecting portion 21 rising up while being perpendicular to the body 30 and to be connected to an external circuit. The externally connecting portion 21 is provided with an elongated bolt hole 23. As shown in FIG. 8, the facing surface 31 is formed into a twill knurled uneven surface. Such knurling is performed, for example, by press-working.

Figure 5:
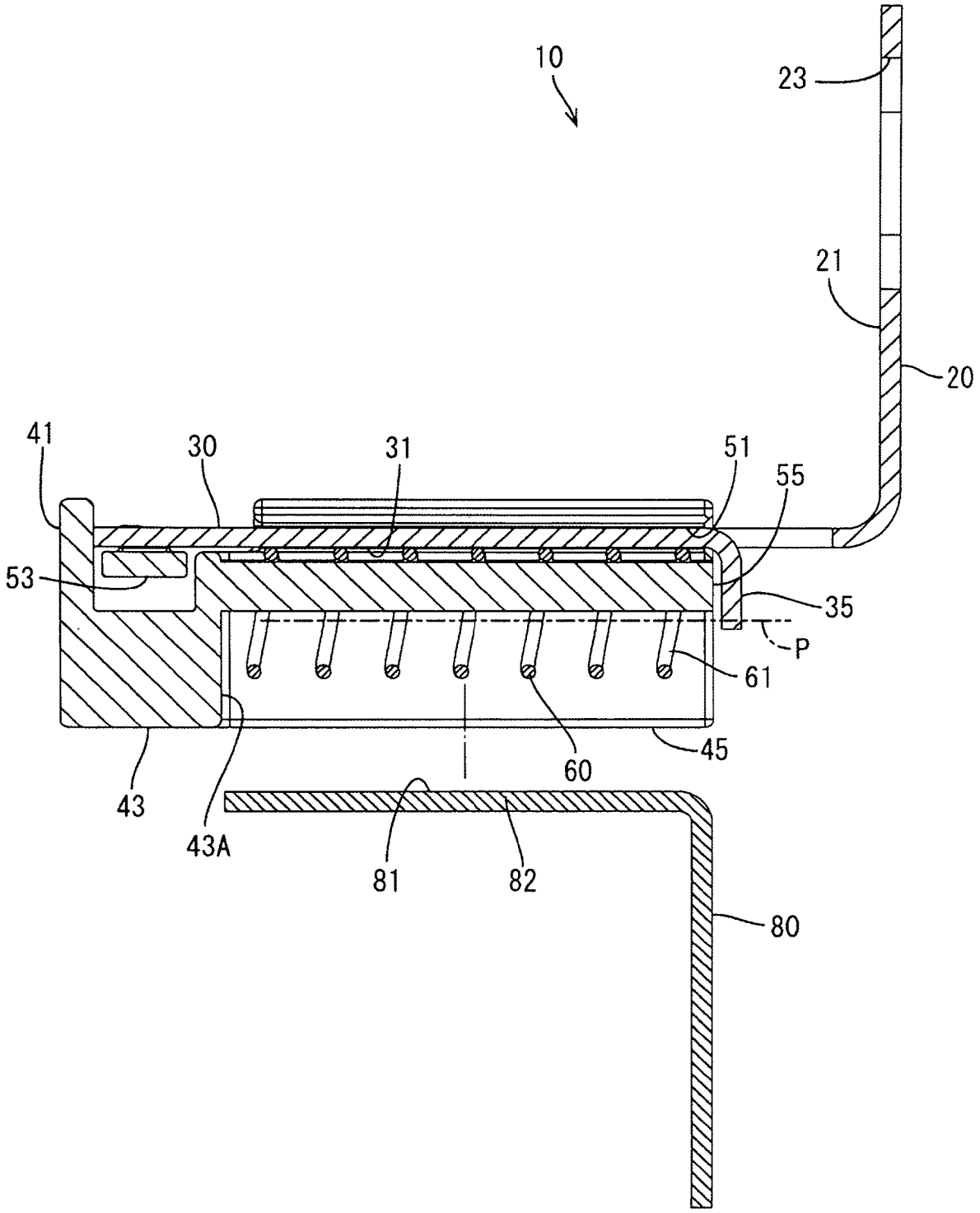
FIG. 5 is a section along A-A in FIG. 4.

As shown in FIGS. 3 and 5, the body 30 is a flat plate and has a rectangular plan view shape with longer sides extending in a front-rear direction and shorter sides extending in a width direction. A dimension of the body portion 30 in the width direction is larger than that of the obliquely wound coil spring 60 in the width direction, and the body portion 30 is formed to have an equal width in the front-rear direction. The lower surface of the body 30 serves as the facing surface 31 described above. A locking hole 33 to be locked to a locking projection 53A of a locking lance 53 to be described later is provided in a front part of the body 30. The locking hole 33 is provided at a position near one widthwise end of the body 30, and a through hole having a rectangular shape in a plan view. Further, a retaining portion 35 is provided on a rear part of the body 30. The retaining portion 35 is formed by being cut and is deformed down at a widthwise central position. The lower end position of the retaining portion 35 is lower than a position where a holding shaft 55 to be described later is provided. A dimension of the body 30 in the front-rear direction is longer than a dimension of the obliquely wound coil spring 60 in an axial direction (front-rear direction), and the locking hole 33 and the retaining portion 35 are provided before and after a position to be brought into contact with the obliquely wound coil spring 60.

The holder 40 is made of synthetic resin and, as shown in FIGS. 3 and 5, formed into a box shape as a whole by a front wall 41, a locking portion 43 provided behind and adjacent to the front wall 41 and two holding walls 45 extending rearward from a rear end surface 43A of the locking portion 43. A front end part of the body 30 of the electrical contact 20 is in contact with the rear surface of the front wall 41. The holding walls 45 extending in parallel are disposed at a predetermined interval from each other, and a lower opening open downward of a space between the holding walls 45 serves as an opening 47 into which the mating terminal 80 is inserted. An inner dimension between the holding walls 45 (width of the opening 47) is equal to or slightly larger than an outer dimension of the mating terminal 80 in the width direction.

Further, as shown in FIGS. 3 and 5, holding grooves 51 are provided in upper end parts of the holding walls 45 and are capable of holding the body 30 of the electrical contact 20 inserted therein. The holding groove 51 is provided by recessing the inner surface of the holding wall 45 outwardly in the width direction. Groove widths of the holding grooves 51 are equal to or slightly larger than a plate thickness of the body 30 of the electrical contact 20. Further, upper wall parts of the holding grooves 51 project farther in than the inner surfaces of the holding walls 45 to suppress upward lifting of the electrical contact member 20.

As shown in FIG. 3, the locking portion 43 includes the locking lance 53 extending in a short side direction of the body 30 of the electrical contact 20. The locking lance 53 is cantilevered from one end toward the other end of the locking portion 43 in the width direction and is resiliently deformable in a vertical direction. Further, a deflection space is provided below the locking lance 53 of the locking portion 43. Since the locking lance 53 extends in the width direction in this way, a dimension of the locking lance 53 in the front-rear direction can be reduced. Further, the upper surface of the locking lance 53 is substantially flush with lower inner wall parts of the holding grooves 51 and can horizontally hold the body 30 of the electrical contact 20. Further, a locking projection 53A lockable to the locking hole 33*o* projects up on the other end side (free end side) of the locking lance 53. The locking projection 53A of the locking lance 53 is fit into the locking hole 33 so that the body 30 of the electrical contact member 20 is locked in the holder 40.

As shown in FIG. 5, the rear end surface 43A of the locking portion 43 is parallel to the retaining portion 35 of the electrical contact 20 locked in the holder 40 and located on a side opposite to the retaining portion 35 across the obliquely wound coil spring 60. As shown in FIGS. 3 and 5, the cylindrical holding shaft 55 projects rearward from the rear end surface 43A of the locking portion 43. The holding shaft 55 is inserted into the obliquely wound coil spring 60 and holds the obliquely wound coil spring 60 at a position between the facing surface 31 of the electrical contact 20 and a contact surface 81 of the mating terminal 80 to be described later. The rear end of the holding shaft 55 is located at the same position as those of the holding walls 45, and such a clearance that the obliquely wound coil spring 60 does not fall therethrough is defined between the retaining portion 35 and the holding shaft 55.

As shown in FIGS. 3 to 5, the obliquely wound coil spring 60 is formed by spirally winding a conductive wire material 61 with respect to a coil axis P, and is straight along the coil axis P. The inclination of the conductive wire material 61 of the obliquely wound coil spring 60 with respect to the coil axis P is set within 90° (tilted in one direction) when viewed laterally. Further, similarly to general coil springs, an angle to the coil axis P differs at each half turn position, but all of the turns are inclined in the same direction with respect to the coil axis P. An end surface (surface viewed from front or behind) of the obliquely wound coil spring 60 is somewhat elliptical. If a load is applied to sandwich the obliquely wound coil spring 60 from both sides in a minor axis direction, each turn of the conductive wire material 61 is tilted farther toward the coil axis P and is deformed to reduce a height (dimension in a direction perpendicular to the coil axis P) of the obliquely wound coil spring 60. Note that the obliquely wound coil spring 60 has a nonlinear region where a spring load hardly changes even if a displacement amount of the obliquely wound coil spring 60 (spring height displacement amount) is changed.

As shown in FIGS. 3 and 5, the obliquely wound coil spring 60 is arranged in such an orientation that the coil axis P thereof is parallel to and along the facing surface 31. The holding shaft 55 is inserted into the obliquely wound coil spring 60 so that the minor axis direction viewed from the axial direction of the coil axis P is the vertical direction, one end of this holding shaft 55 is coupled to the rear end surface 43A of the locking portion 43, and the retaining portion 35 is disposed on the other end. Thus, the obliquely wound coil spring 60 is held so not to come off the holding shaft 55.

A dimension of the obliquely wound coil spring 60 in the front-rear direction in a natural state is shorter than that of the holding shaft 55 in the front-rear direction. Further, the obliquely wound coil spring 60 is tilted toward the coil axis P (to reduce the angle with respect to the coil axis P) by being vertically sandwiched at the time of connection to the mating terminal 80. Thus, a dimension in the minor axis direction viewed from the axial direction of the coil axis P is reduced and the dimension in the front-rear direction also is reduced due to a narrowed pitch in the front-rear direction The mating terminal 80 is made of conductive metal and is formed into a substantially L shape by bending a flat conductive metal plate extending straight substantially at a right angle, as shown in FIGS. 4 and 5. The upper surface of the butting portion 82 of the mating terminal 80 facing the facing surface 31 of the electrical contact 20 serves as the contact surface 81. A dimension of the butting portion 82 in the front-rear direction is equal to that of the holding shaft 55 in the front-rear direction and is longer than the dimension of the obliquely wound coil spring 60 in the front-rear direction in the natural state. Further, a dimension of the butting portion 82 in the width direction is larger than an outer diameter of the obliquely wound coil spring 60. As shown in FIG. 8, the contact surface 81 of the butting portion 82 is formed into a twill knurled uneven surface. Such knurling is performed, for example, by press-working.

The terminal module 10 is configured as described above and an assembling method thereof is described. First, the obliquely wound coil spring 60 is inserted into a rear opening between the holding walls 45 of the holder 40. When the holding shaft 55 is inserted into the obliquely wound coil spring 60 and the obliquely wound coil spring 60 is pushed forward, an end part of the obliquely wound coil spring 60 contacts the rear end surface 43A of the locking portion 43 to stop any further forward pushing of the obliquely wound coil spring 60.

With the holding shaft 55 inserted in the obliquely wound coil spring 60, the electrical contact member 20 is inserted into the holding grooves 51 from behind. When the front end of the body 30 is inserted into the holding grooves 51, the body 30 is pushed forward and the front end of the body 30 reaches the locking portion 43, the locking lance 53 is deformed resiliently down. When the locking hole 33 is at a position above the locking projection 53A, the locking lance 53 resiliently returns, the locking projection 53A of the locking lance 53 is locked into the locking hole 33 and the electrical contact member 20 is locked in the holder 40. At this time, since the retaining portion 35 is located on the side opposite to the rear end surface 43A of the locking portion 43 across the obliquely wound coil spring 60 and almost no clearance is formed between the retaining portion 35 and the rear end of the holding shaft portion 55, a state where the holding shaft 55 is inserted in the obliquely wound coil spring 60 is held. Further, the upper surface of the locking lance 53 is covered by the electrical contact 20. Thus, the locking lance 53 is not exposed to outside and unintended unlocking can be suppressed.

By inserting the holding shaft 55 in the holder 40 into the obliquely wound coil spring 60, thereafter inserting the electrical contact 20 into the holder 40 and fitting and locking the locking projection 53A of the locking lance 53 into the locking hole 33 of the electrical contact member 20 in this way, the electrical contact 20 is locked in the holder 40. When the electrical contact 20 is locked, the obliquely wound coil spring 60 is positioned by the rear end surface 43A of the locking portion 43 and the retaining portion 35 and retained with respect to the holding shaft 55. The terminal module 10 is assembled merely by an assembling operation without using welding or the like, as just described. Thus, the terminal module 10 is manufactured easily. Further, each component can be exchanged even if a trouble caused by aged deterioration during use occurs. Thus, cost for a repair can be reduced. Additionally, the simple structure of mounting the straight obliquely wound coil spring 60 on the outer periphery of the holding shaft 55 is conducive to miniaturization of the terminal module 1. Further, since it is not necessary to cut a groove or the like for holding the obliquely wound coil spring 60, processing cost can be reduced.

In the assembled terminal module 10, the inner peripheral surface of the obliquely wound coil spring 60 is supported in contact with the outer peripheral surface of the holding shaft 55, as shown in FIGS. 4 and 5 in a state before the mating terminal 80 contacts the obliquely wound coil spring 60. Since the holding shaft portion 55 is substantially parallel to the facing surface 31 of the electrical contact member 20, the coil axis P of the obliquely wound coil spring 60 also is substantially parallel to the facing surface 31 of the electrical contact 20.

Subsequently, as the terminal module 10 and the mating terminal 80 are brought closer, the contact surface 81 of the mating terminal 80 contacts a lower end part (lower end part in the minor axis direction) of the outer periphery of the obliquely wound coil spring 60, and an upper end part (upper end part in the minor axis direction) of the outer periphery of the obliquely wound coil spring 60 contacts the facing surface 31 of the electrical contact 20. As the obliquely wound coil spring 60 is sandwiched between the contact surface 81 and the facing surface 31, the conductive wire material 61 is deflected and deformed to be tilted toward the coil axis P while sliding on the contact surface 81 and the facing surface 31.

At this time, the contact surface 81 and the facing surface 31 are formed into twill knurled uneven surfaces, as shown in FIG. 8 in this embodiment. Thus, frictional resistance between the conductive wire material 61 and the contact surface 81 and between the conductive wire material 61 and the facing surface 31 increases as compared to the case where the contact surface 81 and the facing surface 31 are not formed into uneven surfaces. Since the conductive wire material 61 needs to slide against this frictional resistance, a stronger force is necessary to slide as compared to the case where the contact surface 81 and the facing surface 31 are not formed into uneven surfaces. Specifically, since a stronger force is necessary in both a direction along the contact surface 81 and a direction along the facing surface 31 (i.e. front-rear direction), a stronger force is necessary in both a direction perpendicular to the facing surface 81 and a direction perpendicular to the facing surface 31 (i.e. vertical direction) by that much. As a result, a large contact pressure is generated in the vertical direction between the contact surface 81 and the conductive wire material 61 and between the facing surface 31 and the conductive wire material 61. Thus, contact resistance can be reduced.

Figure 6:
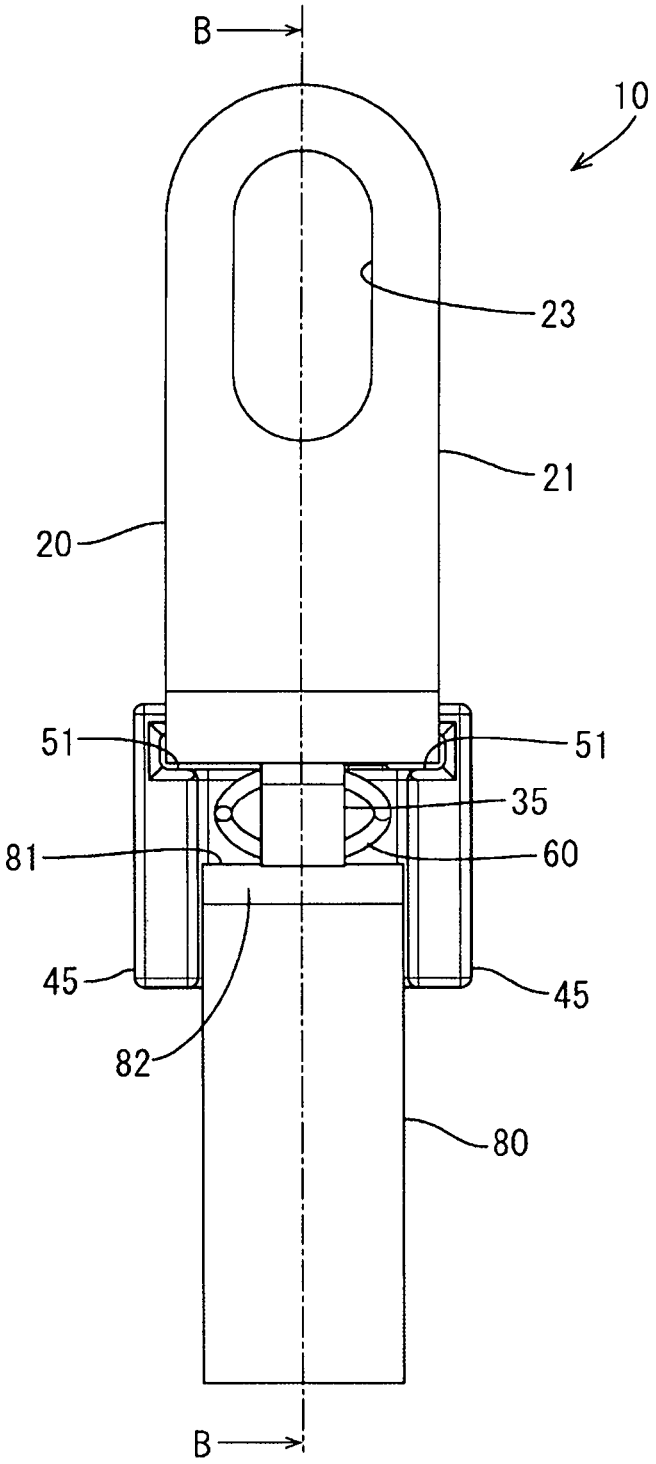
FIG. 6 is a back view showing a state after the terminal module is connected to the mating terminal.
Figure 7:
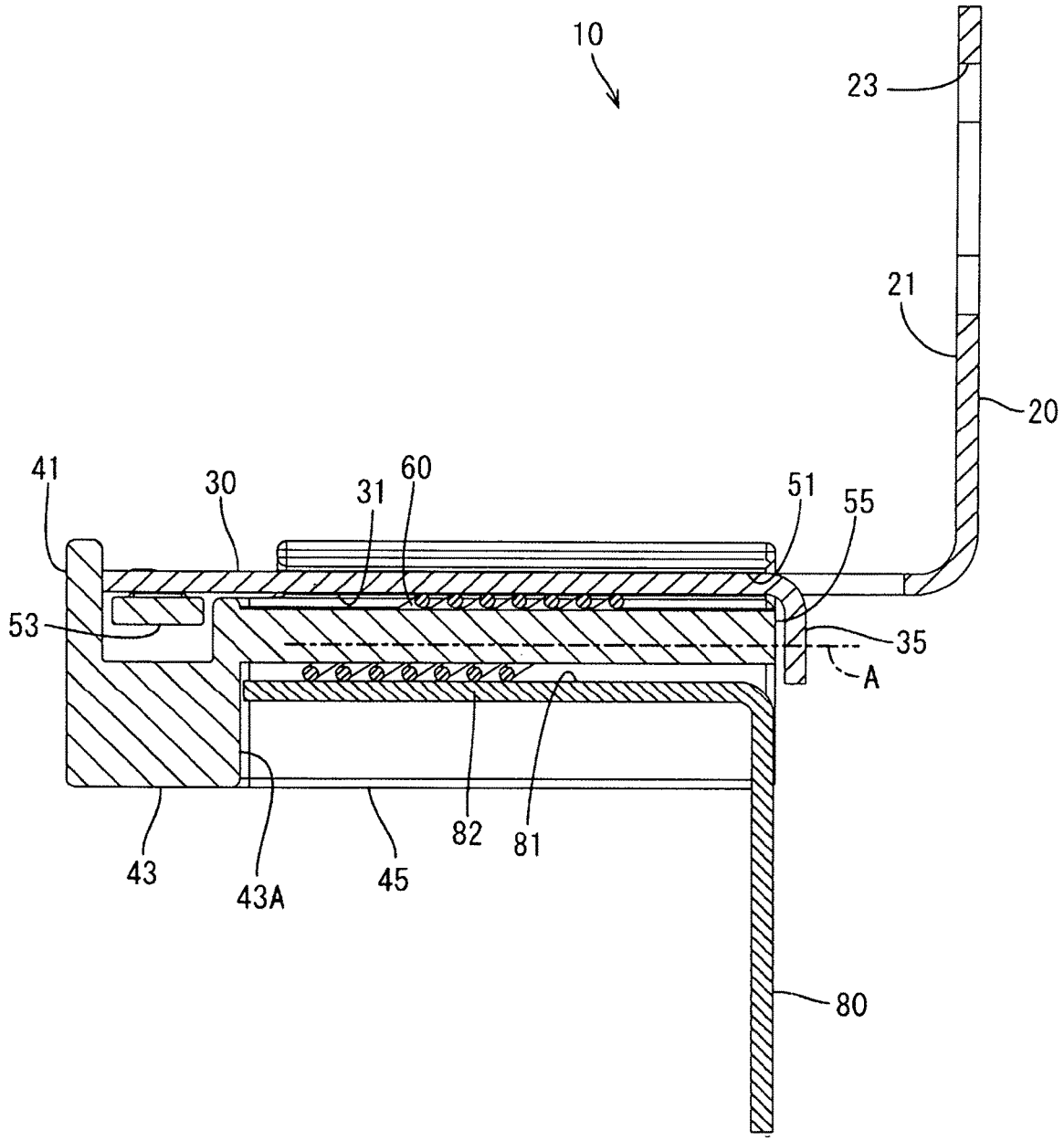
FIG. 7 is a section along B-B in FIG. 6.

Thereafter, as shown in FIGS. 6 and 7, the obliquely wound coil spring 60 is sandwiched in the vertical direction between the contact surface 81 of the mating terminal 80 and the facing surface 31 of the electrical contact member 20. In this way, the mating terminal 80 and the electrical contact 20 are connected electrically via the obliquely wound coil spring 60. In this state, the electrical contact 20 and the mating terminal 80 are in contact with the obliquely wound coil spring 60 at many points. The many contact points can be ensured and the contact resistance can be reduced. Further end parts of the obliquely wound coil spring 60 are not fixed. Thus, the dimension of the obliquely wound coil spring 60 in the front-rear direction becomes shorter than that before connection to the mating terminal 80 and the settling of the obliquely wound coil spring 60 due to plastic deformation or the like is less likely to occur by the obliquely wound coil spring 60 being deflected and deformed in a state close to a natural state.

As described above, at least one of the facing surface 31 and the contact surface 82 is formed into an uneven surface in this embodiment, and the obliquely wound coil spring 60 slides on the uneven surface to increase the frictional resistance. Therefore, the obliquely wound coil spring 60 is less likely to be tilted toward the coil axis P and the contact pressure increases. Accordingly, the contact resistance easily is reduced. The conductive wire material 61 of the obliquely wound coil spring 60 may be thickened only to increase the contact pressure, but this cannot be said to be a good idea for the following reasons. If the conductive wire material 61 is thickened, the obliquely wound coil spring 60 becomes larger. This is disadvantageous in miniaturizing the entire terminal module 10. In addition, the flexibility of the conductive wire material 61 is reduced to make the obliquely wound coil spring 60 easily settled.

In short, by adopting the above configuration, connection reliability equal to or more than that before can be obtained while the conductive wire material 61 thinner than before is used. Further, by thinning the conductive wire material 61, flexibility increases, the settling of the obliquely wound coil spring 60 is less likely to occur and the entire terminal module 10 can be miniaturized. Further, since the obliquely wound coil spring 60 need not be formed into an annular shape, the terminal module 10 can be processed inexpensively. Furthermore, the obliquely wound coil spring 60 can be deflected and deformed naturally. Therefore extra stress and the like do not act on the conductive wire material 61 and an effect of making the obliquely wound coil spring less likely to be settled can be expected.

Both the facing surface 31 and the contact surface 81 may be formed into uneven surfaces. According to this configuration, the obliquely wound coil spring 60 is less likely to be tilted with respect to the coil axis P. Thus, the contact pressure increases and the contact resistance decreases so that larger current applications can be dealt with.

The holder 40 holds the electrical contact 20 and the obliquely wound coil spring 60 and into which the mating terminal 80 is insertable. Accordingly, the configuration of the electrical contact 20 can be simplified as compared to the case where the obliquely wound coil spring 60 is held by the electrical contact 20. For example, since the electrical contact member 20 need not be provided with a hole or the like for fixing the obliquely wound coil spring 60, the processing cost of the electrical contact 20 is reduced and a conductor cross-sectional area of the electrical contact 20 is not reduced by the hole or the like.

The invention is not limited to the above described and illustrated embodiment. For example, the following various modes are also included.

Figure 9:
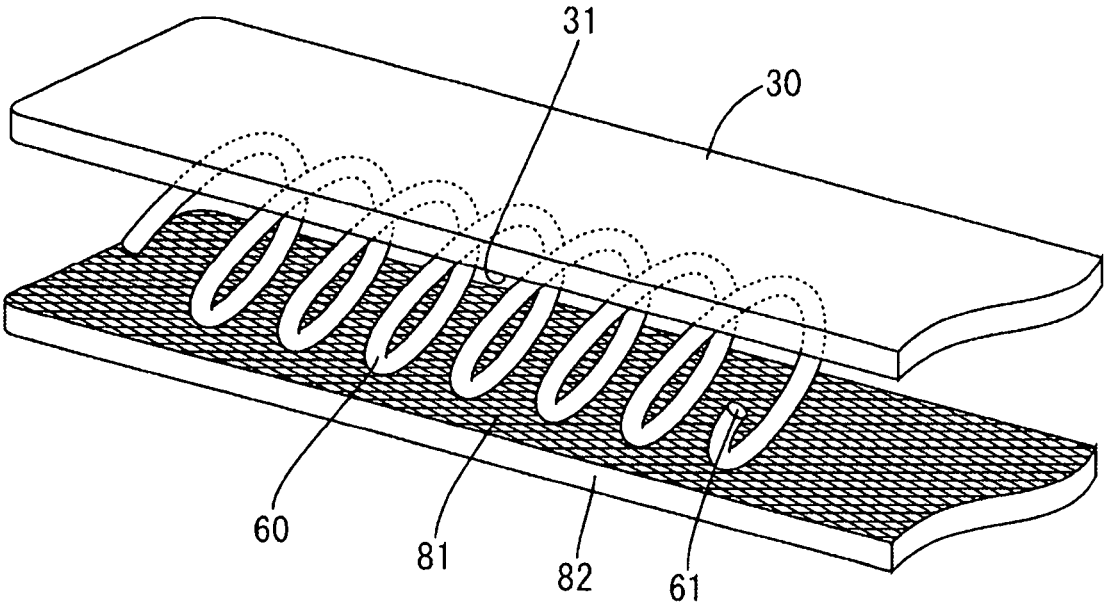
FIG. 9 is a perspective view showing a state where an obliquely wound coil spring is disposed between a contact surface and a facing surface in another embodiment.

Although the facing surface 31 and the contact surface 81 are both formed into uneven surfaces in the above embodiment, only the contact surface 81 may be formed into an uneven surface, as shown in FIG. 9.

Although the obliquely wound coil spring 60 is held by the holder 40 made of synthetic resin in the above embodiment, the obliquely wound coil spring 60 may be held by assembling a resin component capable of accommodating the obliquely wound coil spring 60 with the body 30. In this case, a housing made of resin for holding the electrical contact member 20 may be prepared separately and formed with an opening through which the mating terminal 80 is inserted.

Although the twill knurled surface is illustrated as an example of the uneven surface in the above embodiment, serration other than a twill pattern may be provided or roughening may be performed by matting.

LIST OF REFERENCE SIGNS

10 . . . terminal module
20 . . . electrical contact member
30 . . . body portion
31 . . . facing surface
40 . . . holder
60 . . . obliquely wound coil spring
61 . . . conductive wire material
80 . . . mating terminal
81 . . . contact surface
82 . . . butting portion
P . . . coil axis

The invention claimed is:

1. A terminal module, comprising:

an electrical contact including a body having a facing surface facing a butting portion provided on a mating terminal; and an obliquely wound coil spring coiled by winding a conductive wire material a plurality of times, all turns of the conductive wire material being inclined in the same direction with respect to a coil axis, the obliquely wound coil spring being oriented such that the coil axis is parallel to the body of the electrical contact, the obliquely wound coil spring being sandwiched between the mating terminal and the electrical contact by the conductive wire material being deformed to tilt in one direction toward the coil axis when the mating terminal and the electrical contact approach so that the facing surface contacts a first outer surface of the spring and the contact surface contacts a second outer surface of the spring that is opposite the first outer surface; wherein at least one of the facing surface on the body of the electrical contact on which the obliquely wound coil spring slides and a contact surface on the butting portion of the mating terminal on which the obliquely wound coil spring slides is formed into an uneven surface for increasing frictional resistance during sliding.

2. The terminal module of claim 1, wherein both the facing surface and the contact surface are formed into uneven surfaces.

3. The terminal module of claim 2, further comprising a holder configured to hold the electrical contact member and the obliquely wound coil spring, the mating terminal being insertable into the holder.

4. The terminal module of claim 1, wherein the facing surface and the contact surface are planar.

5. The terminal module of claim 1, wherein the facing surface and the contact surface are parallel to each other.

6. The terminal module of claim 1, wherein the facing surface and the contact surface are externally tangent to the spring.

* * * * *